United States Patent [19]

Kalnes et al.

[11] Patent Number: 4,923,590

[45] **Date of Patent: * May 8, 1990**

[54] PROCESS FOR TREATING A TEMPERATURE-SENSITIVE HYDROCARBONACEOUS STREAM CONTAINING A NON-DISTILLABLE COMPONENT TO PRODUCE A HYDROGENATED DISTILLABLE HYDROCARBONACEOUS PRODUCT

[75] Inventors: Tom N. Kalnes, La Grange; Robert B. James, Jr., Northbrook, both of Ill.

[73] Assignee: UOP, Des Plaines, Ill.

[ * ] Notice: The portion of the term of this patent subsequent to Apr. 4, 2006 has been disclaimed.

[21] Appl. No.: 302,518

[22] Filed: Jan. 27, 1989

Related U.S. Application Data

[63] Continuation-in-part of Ser. No. 84,954, Aug. 13, 1987, abandoned.

[51] Int. Cl.[5] ..... C10G 65/04

[52] U.S. Cl. ..... 208/85; 208/89; 208/107; 208/144; 208/262.1; 208/262.5

[58] Field of Search ..... 208/85, 89, 143, 144, 208/107, 67, 262.1, 262.5, 57

[56] References Cited

U.S. PATENT DOCUMENTS

| | | | |
|---|---|---|---|
| 2,166,177 | 7/1939 | Peterkin | 196/49 |
| 3,089,843 | 5/1963 | Eastman | 208/80 |
| 3,224,959 | 12/1965 | Schlinger et al. | 208/107 |
| 3,228,871 | 1/1966 | Schlinger | 208/58 |
| 3,448,039 | 6/1969 | Tarhan | 208/255 |
| 3,738,931 | 6/1973 | Frankovich et al. | 208/67 |
| 3,992,285 | 11/1976 | Hutchings | 208/208 R |
| 4,029,571 | 6/1977 | Curtin | 208/106 |
| 4,075,084 | 2/1978 | Skripek et al. | 208/93 |
| 4,481,101 | 11/1984 | Yan | 208/106 |
| 4,536,280 | 8/1985 | White et al. | 208/106 |
| 4,719,007 | 1/1988 | Johnson et al. | 208/251 H |
| 4,747,937 | 5/1988 | Hilfman et al. | 208/251 R |
| 4,818,368 | 4/1989 | Kalnes et al. | 208/57 |

*Primary Examiner*—Anthony McFarlane

*Attorney, Agent, or Firm*—Thomas K. McBride; John G. Tolomei; John G. Cutts, Jr.

[57] ABSTRACT

A process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a first hydrogen-rich gaseous stream having a temperature greater than the hydrocarbonaceous stream in a flash zone at flash conditions thereby increasing the temperature of the hydrocarbonaceous stream with minimal thermal degradation and vaporizing at least a portion thereof to provide a hydrocarbonaceous vapor stream comprising hydrogen and a heavy product comprising the non-distillable component; (b) contacting the hydrocarbonaceous vapor stream comprising hydrogen recovered from step (a) without intermediate separation with a hydrogenation catalyst in a hydrogenation reaction zone at hydrogenation conditions to increase the hydrogen content of the hydrocarbonaceous compounds contained in the hydrocarbonaceous vapor stream; (c) condensing at least a portion of the resulting effluent from the hydrogenation reaction zone to provide a second hydrogen-rich gaseous stream and a liquid stream comprising hydrogenated distillable hydrocarbonaceous compounds; and (d) recovering a hydrogenated distillable hydrocarbonaceous product from the liquid stream comprising hydrogenated distillable hydrocarbonaceous compounds.

32 Claims, 1 Drawing Sheet

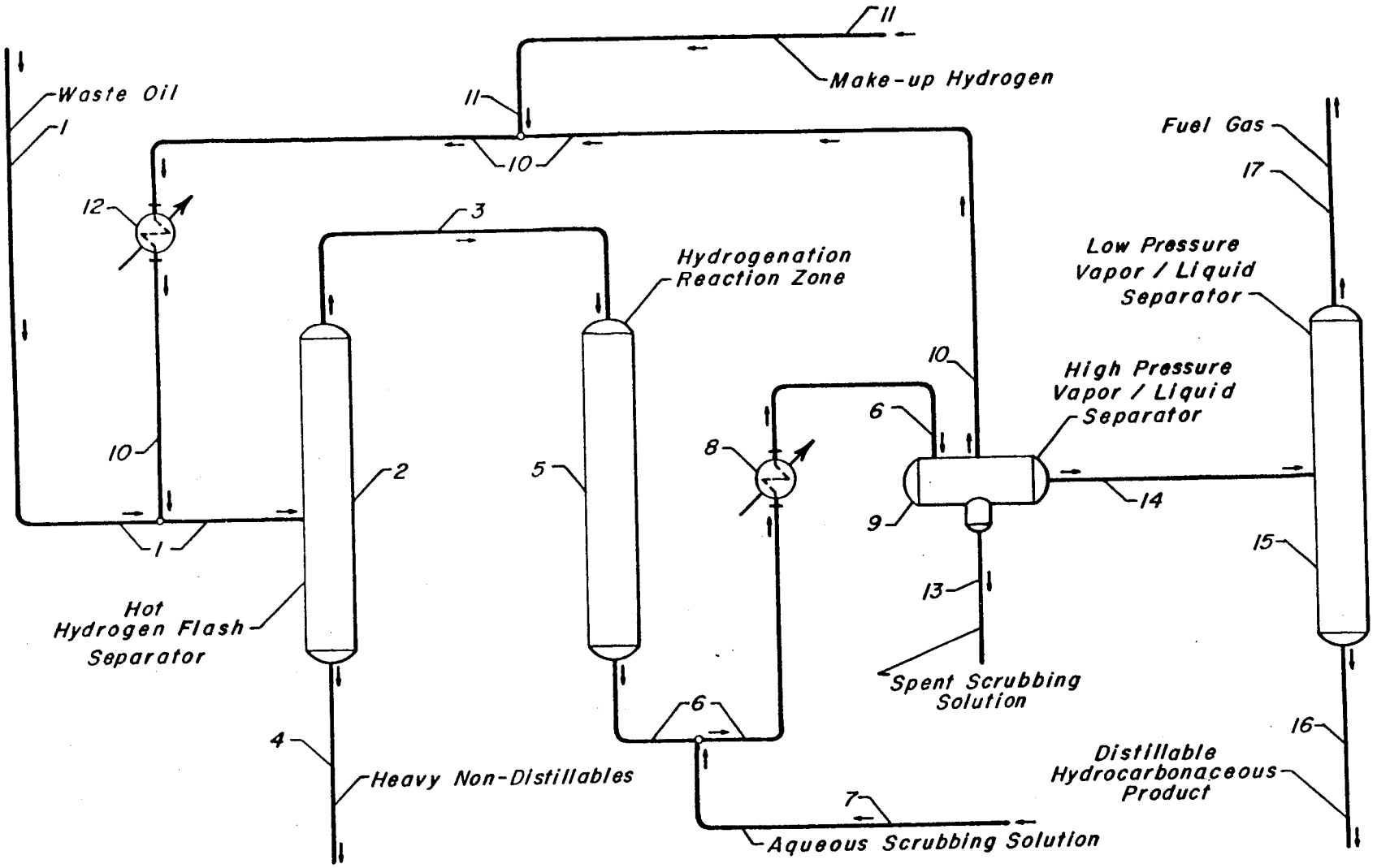
Fuel Gas
17
Low Pressure Vapor / Liquid Separator
High Pressure Vapor / Liquid Separator
14
15
16
Distillable Hydrocarbonaceous Product
Make-up Hydrogen
11
10
6
9
13
Spent Scrubbing Solution
7
Aqueous Scrubbing Solution
Hydrogenation Reaction Zone
8
5
3
2
Heavy Non-Distillables
4
Hot Hydrogen Flash Separator
1
12
Waste Oil

PROCESS FOR TREATING A TEMPERATURE-SENSITIVE HYDROCARBONACEOUS STREAM CONTAINING A NON-DISTILLABLE COMPONENT TO PRODUCE A HYDROGENATED DISTILLABLE HYDROCARBONACEOUS PRODUCT

CROSS REFERENCE TO RELATED APPLICATION

This application is a continuation-in-part of application Ser. No. 084,954, filed Aug. 13, 1987, now abandoned all the teachings of which are hereby incorporated by reference.

BACKGROUND OF THE INVENTION

The field of art to which this invention pertains is the production of a hydrogenated distillable hydrocarbonaceous product from a temperature-sensitive hydrocarbonaceous stream containing a non-distillable component. More specifically, the invention relates to a process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a first hydrogen-rich gaseous stream having a temperature greater than the hydrocarbonaceous stream in a flash zone at flash conditions thereby increasing the temperature of the hydrocarbonaceous stream with minimal thermal degradation and vaporizing at least a portion thereof to provide a hydrocarbonaceous vapor stream comprising hydrogen and a heavy product comprising the non-distillable component; (b) contacting the hydrocarbonaceous vapor stream comprising hydrogen recovered from step (a) without intermediate separation with a hydrogenation catalyst in a hydrogenation reaction zone at hydrogenation conditions to increase the hydrogen content of the hydrocarbonaceous compounds contained in the hydrocarbonaceous vapor stream; (c) condensing at least a portion of the resulting effluent from the hydrogenation reaction zone to provide a second hydrogen-rich gaseous stream and a liquid stream comprising hydrogenated distillable hydrocarbonaceous compounds; and (d) recovering a hydrogenated distillable hydrocarbonaceous product from the liquid stream comprising hydrogenated distillable hydrocarbonaceous compounds.

INFORMATION DISCLOSURE

In U.S. Pat. No. 3,992,285 (Hutchings), a process is disclosed for the desulfurization of a hydrocarbonaceous black oil containing sulfur and asphaltic material which comprises preheating the oil by indirect heat exchange to a temperature not in excess of about 550° F., commingling the preheated oil with a steamcontaining gas to raise the temperature of the oil to a desulfurization temperature of about 600° F. to about 800° F. and contacting the thus heated oil at hydrocarbon conversion conditions with a desulfurization catalyst.

In U.S. Pat. No. 3,738,931 (Frankovich et al), a process is disclosed for the catalytic hydrogenation of a hydrocarbonaceous vapor stream whereby the vapor stream is obtained by contacting the oil feed with cold, recycled hydrogen, visbreaking (thermal degradation and conversion) the mixture of oil feed and hydrogen and subsequently separating the vapor distillable fraction from the liquid non-distillable fraction in a separation zone after the oil feed has been visbroken. The resulting vapor distillable fraction is then sent to a catalytic hydrogenation zone.

In U.S. Pat. No. 2,166,177 (Peterkin), discloses a two-stage visbreaking process whereby an oil feed is purposefully heated via indirect heat exchange to thermally convert (visbreak) the oil feed in order to obtain lower boiling hydrocarbonaceous products such as naphtha. The '177 patent teaches that only after the oil feed has been (1) heated via indirect heat exchange, (2) flashed in a high residence time flash pot, (3) heated via indirect heat exchange for a second time, and (4) finally heated even more in the convection coils of a furnace is the remainder (or what remains) of the feed oil contacted with a vaporizing fluid. The vaporizing fluid is exemplified as naphtha, hydrocarbon gas, steam, carbon dioxide or the like and does not disclose a hydrogen-rich gas.

In U.S. Pat. No. 3,228,871 (Schlinger), a process is disclosed for the hydroconversion of oil which comprises passing an admixture of the oil and hydrogen through a tubular reaction zone, separating the effluent from the tubular reaction zone into a liquid portion and a gaseous portion, collecting the separated liquid and recycling at least a portion of the collected liquid portion to the tubular reaction zone, cooling the gaseous portion and passing the resulting cooled gaseous portion into contact with a hydrogenation catalyst and recovering normally liquid hydrocarbons from the catalytic hydrogenation zone effluent.

In U.S. Pat. No. 3,448,039 (Tarhan), a process is disclosed for treating unpreheated liquid aromatic hydrocarbon feedstock containing polymerizable impurities which comprises completely vaporizing the feedstock by admixture with hot hydrogen in the presence of a hydrogenation catalyst in a reaction zone, reacting the polymerizable impurities of the feedstock in the reaction zone in the presence of catalyst and thereby converting the impurities to a non-polymerizable form and removing the treated feedstock and excess hydrogen as gaseous effluent from the reaction zone.

In U S. Pat. No. 4,747,937 (Hilfman et al) and U.S. Pat. No. 4,719,007 (Johnson et al), a process is disclosed wherein the effluent from a hydrogenation zone is contacted with an aqueous scrubbing solution.

BRIEF SUMMARY OF THE INVENTION

The invention provides an improved process for the production of a hydrogenated distillable hydrocarbonaceous product from a temperature-sensitive hydrocarbonaceous stream containing a non-distillable component by means of contacting the hydrocarbonaceous feed stream with a hot hydrogen-rich gaseous stream to increase the temperature of the feed stream with minimal thermal degradation and to vaporize at least a portion of the distillable hydrocarbonaceous compounds thereby producing a distillable hydrocarbonaceous product which is immediately hydrogenated in an integrated hydrogenation zone without intermediate separation. Important elements of the improved process are the relatively short time that the feed stream is maintained at elevated temperature, the avoidance of heating the feed stream via indirect heat exchange to preclude the coke formation that could otherwise occur and the minimization of utility costs due to the integration of the hydrogenation zone.

One embodiment of the invention may be characterized as a process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a first hydrogen-rich gaseous stream having a temperature greater than the hydrocarbonaceous stream in a flash zone at flash conditions thereby increasing the temperature of the hydrocarbonaceous stream with minimal thermal degradation and vaporizing at least a portion thereof to provide a hydrocarbonaceous vapor stream comprising hydrogen and a heavy product comprising the non-distillable component; (b) contacting the hydrocarbonaceous vapor stream comprising hydrogen recovered from step (a) without intermediate separation with a hydrogenation catalyst in a hydrogenation reaction zone at hydrogenation conditions to increase the hydrogen content of the hydrocarbonaceous compounds contained in the hydrocarbonaceous vapor stream; (c) condensing at least a portion of the resulting effluent from the hydrogenation reaction zone to provide a second hydrogen-rich gaseous stream and a liquid stream comprising hydrogenated distillable hydrocarbonaceous compounds; and (d) recovering a hydrogenated distillable hydrocarbonaceous product from the liquid stream comprising hydrogenated distillable hydrocarbonaceous compounds.

Another embodiment of the invention may be characterized as a process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a first hydrogen-rich gaseous stream having a temperature greater than the hydrocarbonaceous stream in a flash zone at flash conditions thereby increasing the temperature of the hydrocarbonaceous stream with minimal thermal degradation and vaporizing at least a portion thereof to provide a hydrocarbonaceous vapor stream comprising hydrogen and a heavy product comprising the non-distillable component; (b) contacting the hydrocarbonaceous vapor stream comprising hydrogen recovered from step (a) without intermediate separation with a hydrogenation catalyst in a hydrogenation reaction zone at hydrogenation conditions to increase the hydrogen content of the hydrocarbonaceous compounds contained in the hydrocarbonaceous vapor stream; (c) condensing at least a portion of the resulting effluent from the hydrogenation reaction zone to provide a second hydrogen-rich gaseous stream and a first liquid stream comprising hydrogenated distillable hydrocarbonaceous compounds; and (d) separating the first liquid stream comprising hydrogenated distillable hydrocarbonaceous compounds to provide a second hydrocarbonaceous vapor stream comprising normally gaseous hydrocarbons and a normally liquid hydrogenated distillable hydrocarbonaceous product.

Yet another embodiment of the invention may be characterized as a process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a first hydrogen-rich gaseous stream having a temperature greater than the hydrocarbonaceous stream in a flash zone at flash conditions thereby increasing the temperature of the hydrocarbonaceous stream with minimal degradation and vaporizing at least a portion thereof to provide a hydrocarbonaceous vapor stream comprising hydrogen and a heavy product comprising the non-distillable component; (b) contacting the hydrocarbonaceous vapor stream comprising hydrogen recovered from step (a) without intermediate separation with a hydrogenation catalyst in a hydrogenation reaction zone at hydrogenation conditions to simultaneously increase the hydrogen content of the hydrocarbonaceous compounds contained in the hydrocarbonaceous vapor stream and to generate at least one water-soluble inorganic compound produced from the reaction of the hydrocarbonaceous compounds and the hydrogen; (c) contacting the resulting effluent from the hydrogenation zone containing hydrogenated hydrocarbonaceous compounds and at least one water-soluble inorganic compound with a fresh aqueous scrubbing solution; (d) introducing a resulting admixture of the effluent from the hydrogenation zone and the aqueous scrubbing solution into a separation zone to provide a second hydrogen-rich gaseous stream, a first liquid stream comprising hydrogenated distillable hydrocarbonaceous compounds and a spent aqueous scrubbing solution containing at least a portion of the water-soluble inorganic compound; and (e) separating the first liquid stream comprising hydrogenated distillable hydrocarbonaceous compounds to provide a second hydrocarbonaceous vapor stream comprising normally gaseous hydrocarbons and a normally liquid hydrogenated distillable hydrocarbonaceous product.

Other embodiments of the present invention encompass further details such as preferred feedstocks, hydrogenation catalysts, aqueous scrubbing solutions and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

There is a steadily increasing demand for technology which is capable of treating a temperature-sensitive hydrocarbonaceous stream containing a non-distillable component to produce a hydrogenated distillable hydrocarbonaceous product and a heavy non-distillable product while minimizing thermal degradation of the hydrocarbonaceous feed stream. Such treatment has always been in demand for the preparation and production of various hydrocarbonaceous products but with the increased environmental emphasis for the treatment and recycle of waste hydrocarbonaceous products there is an increased need for improved processes to separate heavy non-distillable components from a distillable hydrocarbonaceous product which may then be hydrogenated. For example, during the disposal or recycle of potentially environmentally harmful hydrocarbonaceous waste streams, an important step in the total solution to the problem is the pretreatment or conditioning of a hydrocarbonaceous stream which facilitates the ultimate resolution to provide product streams which may subsequently be handled in an environmentally acceptable manner. Therefore, those skilled in the art have sought to find feasible techniques to remove heavy non-distillable components from a temperature-sensitive hydrocarbonaceous stream to provide a distillable hydrocarbonaceous product which may then be hydrogenated. Previous techniques which have been employed include filtration, vacuum wiped film evaporation, centrifugation, and vacuum distillation.

The present invention provides an improved integrated process for the removal of heavy non-distillable components from a temperature-sensitive hydrocarbonaceous stream and the subsequent hydrogenation of the distillable hydrocarbonaceous stream. In addition, since the thermal degradation of the feedstock is minimized, the overall yield of the hydrogenated distillable hydrocarbonaceous product stream is thereby maximized resulting in more favorable and economical operation. A wide variety of temperature-sensitive hydrocarbonaceous streams are to be candidates for feed streams in accordance with the process of the present invention. Examples of hydrocarbonaceous streams which are suitable for treatment by the process of the present invention are dielectric fluids, hydraulic fluids, heat transfer fluids, used lubricating oil, used cutting oils, used solvents, still bottoms from solvent recycle operations, coal tars, atmospheric residuum, oils contaminated with polychlorinated biphenyls (PCB), halogenated wastes and other hydrocarbonaceous industrial waste. Many of these hydrocarbonaceous streams may contain non-distillable components which include, for example, organometallic compounds, inorganic metallic compounds, finely divided particulate matter and non-distillable hydrocarbonaceous compounds. The present invention is particularly advantageous when the non-distillable components comprise sub-micron particulate matter and the conventional techniques of filtration or centrifugation tend to be highly ineffective.

The presence of a non-distillable component including finely divided particulate matter in a hydrocarbonaceous feed to a hydrogenation zone greatly increases the difficulty of the hydrogenation. A non-distillable component tends 1) to foul the hot heat exchange surfaces which are used to heat the feed to hydrogenation conditions, 2) to form coke or in some other manner deactivate the hydrogenation catalyst thereby shortening its active life and 3) to otherwise hinder a smooth and facile hydrogenation operation. Particulate matter in a feed stream tends to deposit within the hydrogenation zone and to plug a fixed hydrogenation catalyst bed thereby abbreviating the time on stream.

Once the temperature-sensitive hydrocarbonaceous feed stream is separated into a distillable hydrocarbonaceous stream and a heavy non-distillable product, the resulting distillable hydrocarbonaceous stream is introduced into a hydrogenation zone. If the feed stream contains metallic compounds contain metals such as zinc, copper, iron, barium, phosphorus, magnesium, aluminum, lead, mercury, cadmium, cobalt, arsenic, vanadium, chromium, and nickel, these compounds will be isolated in the relatively small volume of recovered non-distillable product which may then be treated for metals recovery or otherwise disposed of as desired. In the event that the feed stream contains distillable hydrocarbonaceous compounds which include sulfur, oxygen, nitrogen, metal or halogen components, the resulting recovered distillable hydrocarbonaceous stream is hydrogenated to remove or convert such components as desired. In a preferred embodiment of the present invention, the hydrogenation of the resulting distillable hydrocarbonaceous stream is preferably conducted immediately without intermediate separation or condensation. The advantages of the integrated process of the present invention will be readily apparent to those skilled in the art and include the economy of greatly reduced utility costs.

In accordance with the subject invention, a temperature-sensitive hydrocarbonaceous stream containing a non-distillable component is contacted with a hot hydrogen-rich gaseous stream having a temperature greater than the hydrocarbonaceous stream in a flash zone at flash conditions thereby increasing the temperature of the hydrocarbonaceous stream and vaporizing at least a portion thereof to provide a hydrocarbonaceous vapor stream comprising hydrogen and a heavy non-distillable product. The hot hydrogen-rich gaseous stream preferably comprises more than about 70 mole % hydrogen and more preferably more than about 90 mole % hydrogen The hot hydrogen-rich gaseous stream is multi-functional and serves as 1) a heat source used to directly heat the hydrocarbonaceous feed stream to preclude the coke formation that could otherwise occur when using an indirect heating apparatus such as a heater or heat-exchanger, 2) a diluent to reduce the partial pressure of the hydrocarbonaceous compounds during vaporization in the flash zone, 3) a possible reactant to minimize the formation of hydrocarbonaceous polymers at elevated temperatures, 4) a stripping medium and 5) at least a portion of the hydrogen required in the hydrogenation reaction zone. In accordance with the subject invention, the temperature-sensitive hydrocarbonaceous feed stream is preferably maintained at a temperature less than about 482° F. (250° C.) before being introduced into the flash zone in order to prevent or minimize the thermal degradation of the feed stream. Depending upon the characteristics and composition of the hydrocarbonaceous feed stream, the hot hydrogen-rich gaseous stream is introduced into the flash zone at a temperature greater than the hydrocarbonaceous feed stream and preferably at a temperature from about 200° F. (93° C.) to about 1200° F. (649° C.).

During the contacting, the flash zone is preferably maintained at flash conditions which include a temperature from about 150° F. (65° C.) to about 860° F. (460° C.), a pressure from about atmospheric to about 2000 psig (13788 kpa gauge), a hydrogen circulation rate of about 1000 SCFB (168 normal $m^3/m^3$) to about 30,000 SCFB (5056 normal $m/m^3$) based on the temperature-sensitive hydrocarbonaceous feed stream and an average residence time of the hydrogen-containing, hydrocarbonaceous vapor stream in the flash zone from about 0.1 seconds to about 50 seconds. A more preferred average residence time of the hydrogen-containing, hydrocarbonaceous vapor stream in the flash zone is from about 1 second to about 10 seconds.

The resulting heavy non-distillable portion of the feed stream is removed from the bottom of the flash zone as required to yield a heavy non-distillable product. The heavy non-distillable product may contain a relatively small amount of distillable components but since essentially all of non-distillable components contained in the hydrocarbonaceous feed stream are recovered in this product stream, the term "heavy non-distillable product" is nevertheless used for the convenient description of this product stream. The heavy non-distillable product preferably contains a distillable component of less than about 10 weight percent and more preferably less than about 5 weight percent. Under certain circumstances with a feed stream not having an appreciable amount of liquid non-distillable components, it is contemplated that an additional liquid may be utilized to flush the heavy non-distillables from the flash zone. An example of this situation is when the hydrocarbonaceous feed stream comprises a very high percentage of distillable hydrocarbonaceous compounds and relatively small quantities of finely divided particulate matter (solid) and essentially no liquid non-distillable component for use as a carrier for the solids. Such a flush liquid may, for example, be a high boiling range vacuum gas oil having a boiling range from about 700° F. (371° C.) to about 1,000° F. (538° C.) or a vacuum tower bottoms stream boiling at a temperature greater than about 1000° F. (538° C.). The selection of a flush liquid depends upon the composition of the hydrocarbonaceous feed stream and the prevailing flash conditions in the flash separator, and the volume of the flush liquid is preferably limited to that required for removal of the heavy non-distillable component.

The resulting hydrogen-containing, hydrocarbonaceous vapor stream is removed from the flash zone and is introduced into a catalytic hydrogenation zone containing hydrogenation catalyst and maintained at hydrogenation conditions. The resulting hydrogen-containing hydrocarbonaceous vapor stream recovered from the flash zone is directly introduced into the hydrogenation reaction zone without intermediate separation thereof. The catalytic hydrogenation zone may contain a fixed, ebullated or fluidized catalyst bed. This reaction zone is preferably maintained under an imposed pressure from about atmospheric (0 kPa gauge) to about 2000 psig (13790 kpa gauge) and more preferably under a pressure from about 100 psig (689.5 kpa gauge) to about 1800 psig (12411 kPa gauge). Suitably, such reaction is conducted with a maximum catalyst bed temperature in the range of about 122° F. (50° C.) to about 850° F. (454° C.) selected to perform the desired hydrogenation conversion to reduce or eliminate the undesirable characteristics or components of the hydrocarbonaceous vapor stream. In accordance with the present invention, it is contemplated that the desired hydrogenation conversion includes, for example, dehalogenation, desulfurization, denitrification, olefin saturation, oxygenate conversion and hydrocracking. Further preferred operating conditions include liquid hourly space velocities in the range from about 0.05 $hr^{-1}$ to about 20 $hr^{-1}$ and hydrogen circulation rates from about 200 standard cubic feet per barrel (SCFB) (33.71 normal $m^3/m^3$) to about 50,000 SCFB (8427 normal $m^3/m^3$), preferably from about 300 SCFB (50.6 normal $m^3/m^3$) to about 20,000 SCFB (3371 normal $m^3/m^3$).

In the event that the temperature of the hydrogen-containing, hydrocarbonaceous stream which is removed from the flash zone is not deemed to be exactly the temperature selected to operate the catalytic hydrogenation zone, we contemplate that the temperature of the hydrogen-containing, hydrocarbonaceous stream may be adjusted either upward or downward in order to achieve the desired temperature in the catalytic hydrogenation zone. Such a temperature adjustment may be accomplished, for example, by the addition of either cold or hot hydrogen.

The preferred catalytic composite disposed within the hereinabove described hydrogenation zone can be characterized as containing a metallic component having hydrogenation activity, which component is combined with a suitable refractory inorganic oxide carrier material of either synthetic or natural origin. The precise composition and method of manufacturing the carrier material is not considered essential to the present invention. Preferred carrier materials are alumina, silica and mixtures thereof. Suitable metallic components having hydrogenation activity are those selected from the group comprising the metals of Groups VI-B and VIII of the Periodic Table, as set forth in the *Periodic Table of the Elements,* E. H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon a particular metal as well as the physical and/or chemical characteristics of the particular hydrocarbon feedstock. For example, the metallic components of Group VI-B are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. In addition, any catalyst employed commercially for hydrogenating middle distillate hydrocarbonaceous compounds to remove nitrogen and sulfur may function effectively in the hydrogenation zone of the present invention. It is further contemplated that hydrogenation catalytic composites may comprise one or more of the following components: cesium, francium, lithium, potassium, rubidium, sodium, copper, gold, silver, cadmium, mercury and zinc.

The hydrocarbonaceous effluent from the hydrogenation zone is preferably contacted with an aqueous scrubbing solution and the admixture is admitted to a separation zone in order to separate a spent aqueous stream, a hydrogenated hydrocarbonaceous liquid phase and a hydrogen-rich gaseous phase. The contact of the hydrocarbonaceous effluent from the hydrogenation zone with the aqueous scrubbing solution may be performed in any convenient manner and is preferably conducted by co-current, in-line mixing which may be promoted by inherent turbulence, mixing orifices or any other suitable mixing means. The aqueous scrubbing solution is preferably introduced in an amount from about 1 to about 100 volume percent based on the hydrocarbonaceous effluent from the hydrogenation zone. The aqueous scrubbing solution is selected depending on the characteristics of the hydrocarbonaceous vapor stream introduced into the hydrogenation zone. For example, if the hydrocarbonaceous vapor stream to the hydrogenation zone comprises halogenated compounds, the aqueous scrubbing solution preferably contains a basic compound such as calcium hydroxide, potassium hydroxide or sodium hydroxide in order to neutralize the acid such as hydrogen chloride, hydrogen bromide and hydrogen fluoride, for example, which is formed during the hydrogenation of the halogen compounds. In the event that the hydrocarbonaceous vapor stream contains only sulfur and nitrogen compounds, water may be a suitable aqueous scrubbing solution to dissolve the resulting hydrogen sulfide and ammonia. The resulting hydrogenated hydrocarbonaceous liquid phase is recovered and the hydrogen-rich gaseous phase may be recycled to the hydrogenation zone if desired.

The resulting hydrogenated hydrocarbonaceous liquid phase is preferably recovered from the hydrogen-rich gaseous phase in a separation zone which is maintained at essentially the same pressure as the hydrogenation reaction zone and as a consequence contains dissolved hydrogen and low molecular weight normally gaseous hydrocarbons if present. In accordance with the present invention, it is preferred that the hydrogenated hydrocarbonaceous liquid phase comprising the hereinabove mentioned gases be stabilized in a convenient manner, such as, for example, by stripping or flashing to remove the normally gaseous components to provide a stable hydrogenated distillable hydrocarbonaceous product.

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art.

With reference now to the drawing, a liquid hydrocarbonaceous feed stream having a non-distillable component is introduced into the process via conduit 1 and is contacted with a hot gaseous hydrogen-rich recycle stream which is provided via conduit 10 and hereinafter described. The liquid hydrocarbonaceous feed stream and the hydrogen-rich recycle stream are intimately contacted in hot hydrogen flash separator 2. A hydrocarbonaceous vapor stream comprising hydrogen is removed from hot hydrogen flash separator 2 via conduit 3 and introduced into hydrogenation reaction zone 5 without intermediate separation thereof. A heavy non-distillable stream is removed from the bottom of hot hydrogen flash separator 2 viaconduit 4 and recovered. The resulting hydrogenated hydrocarbonaceous stream is removed from hydrogenation reaction zone 5 via conduit 6 and is contacted with an aqueous scrubbing solution which is introduced via conduit 7. The resulting admixture of the hydrogenated hydrocarbonaceous effluent and the aqueous scrubbing solution is passed via conduit 6 and cooled in heat-exchanger 8. The resulting cooled effluent from heat-exchanger 8 is passed via conduit 6 into high pressure vapor/liquid separator 9. A hydrogen-rich gaseous stream is removed from high pressure vapor/liquid separator 9 via conduit 10, heated to a suitable temperature in heat-exchanger 12 and utilized to contact the waste oil feed stream as hereinabove described. Since hydrogen is lost in the process by means of a portion of the hydrogen being dissolved in the exiting liquid hydrocarbon and hydrogen being consumed during the hydrogenation reaction, it is necessary to supplant the hydrogen-rich gaseous stream with make-up hydrogen from some suitable external source, for example, a catalytic reforming unit or a hydrogen plant. Make-up hydrogen may be introduced into the system at any convenient and suitable point, and is introduced in the drawing via conduit 11. A liquid hydrogenated hydrocarbonaceous stream comprising hydrogen in solution is removed from high pressure vapor/liquid separator 9 via conduit 14 and is introduced into low pressure vapor/liquid separator 15. A spent aqueous scrubbing solution is removed from high pressure vapor/liquid separator 9 via conduit 13 and recovered. A gaseous stream comprising hydrogen and any normally gaseous hydrocarbons present is removed from low pressure vapor/liquid separator 15 via conduit 17 and recovered. A normally liquid distillable hydrogenated hydrocarbonaceous product is removed from low pressure vapor/liquid separator 15 via conduit 16 and recovered. In the event that the waste oil feed stream contains water, this water is recovered from high pressure vapor/liquid separator 9 via conduit 13 together with the spent aqueous scrubbing solution as hereinabove described.

The following example is presented for the purpose of further illustrating the process of the present invention, and to indicate the benefits afforded by the utilization thereof in producing a distillable hydrogenated hydrocarbonaceous product while minimizing thermal degradation of the temperature-sensitive hydrocarbonaceous feed stream containing a non-distillable component.

EXAMPLE

A waste lube oil having the characteristics presented in Table 1 and contaminated with 1020 ppm by weight of polychlorinated biphenyl (PCB) was charged at a rate of 100 mass units per hour to a hot hydrogen flash separation zone. The hot hydrogen was introduced into the hot hydrogen flash separation zone at a rate of 31 mass units per hour.

TABLE 1

WASTE LUBE OIL FEEDSTOCK PROPERTIES (5375-45)

| | | |
|---|---|---|
| Specific Gravity @ 60° F. (15° C.) | 0.8827 | |
| Vacuum Distillation Boiling Range, (ASTM D-1160) | °F. | (°C.) |
| IBP | 338 | (170) |
| 10% | 516 | (269) |
| 20% | 628 | (331) |
| 30% | 690 | (367) |
| 40% | 730 | (388) |
| 50% | 750 | (399) |
| 60% | 800 | (421) |
| 70% | 831 | (444) |
| 80% | 882 | (474) |
| % Over | 80 | |
| % Bottoms | 20 | |
| Sulfur, weight percent | 0.5 | |
| Polychlorinated Biphenyl Concentration, wppm | 1020 | |
| Lead, wppm | 863 | |
| Zinc, wppm | 416 | |
| Cadmium, wppm | 1 | |
| Copper, wppm | 21 | |
| Chromium, wppm | 5 | |

The waste lube oil was preheated to a temperature of <482° F. (<250° C.) before introduction into the hot hydrogen flash separation zone which temperature precluded any significant detectable thermal degradation. The waste lube oil was intimately contacted in the hot flash separation zone with a hot hydrogen-rich gaseous stream having a temperature upon introduction into the hot hydrogen flash separation zone of >748° F. (>398° C.). In addition, the hot hydrogen flash separation zone was operated at conditions which included a temperature of 748° F. (398° C.), a pressure of 500 psig (3447 kPa gauge), a hydrogen circulation rate of 18000 SCFB (3034 normal $m^3/m^3$) and an average residence time of the vapor stream of 5 seconds. A hydrocarbonaceous vapor stream comprising hydrogen was recovered from the hot flash separation zone, cooled to 77° F. (25° C.) and introduced into a high pressure separator. An overhead gas stream in an amount of 31 mass units per hour and having the characteristics presented in Table 2 was recovered from the high pressure separator and a hereinafter described low pressure separator.

TABLE 2

| ANALYSIS OF OVERHEAD GAS STREAM | |
|---|---|
| Hydrogen, volume percent | 100 |

A liquid stream was removed from the high pressure separator and introduced into a low pressure separator to provide a portion of the overhead gas stream described hereinabove and a liquid bottoms stream in the amount of 88 mass units per hour having the characteristics presented in Table 3.

TABLE 3

| ANALYSIS OF LOW PRESSURE SEPARATOR BOTTOMS STREAM | | |
|---|---|---|
| Specific Gravity @ 60° F. (15° C.) | 0.866 | |
| Vacuum Distillation Boiling Range, (ASTM D-1160) | °F. | (°C.) |
| IBP | 225 | (107) |
| 10% | 433 | (223) |
| 20% | 538 | (280) |
| 30% | 633 | (334) |
| 40% | 702 | (372) |
| 50% | 741 | (394) |
| 60% | 770 | (410) |
| 70% | 801 | (427) |
| 80% | 837 | (447) |
| 90% | 896 | (479) |
| 95% | 943 | (506) |
| EP | 982 | (527) |
| % Over | 97 | |
| % Bottoms | 3 | |
| Sulfur, weight percent | 0.31 | |
| Polychlorinated Biphenyl Concentration, wppm | 1143 | |
| Lead, wppm | 3.7 | |
| Zinc, wppm | 1.5 | |
| Cadmium, wppm | <0.04 | |
| Copper, wppm | 0.1 | |
| Chromium, wppm | 0.6 | |

A non-distillable liquid stream was recovered from the bottom of the flash separation zone in an amount of 12 mass units per hour and having the characteristics presented in Table 4.

TABLE 4

| analysis OF NON-DISTILLABLE STREAM | |
|---|---|
| Specific Gravity @ 60° F. (15° C.) | >0.9 |
| Polychlorinated Biphenyl Concentration, wppm | 110 |

In summary, this example demonstrated that a waste lube oil having a non-distillable component and containing 1020 wppm of polychlorinated biphenyl and 1306 wppm heavy metals, i.e., lead, zinc, cadmium, copper and chromium, was separated into a distillable hydrocarbonaceous stream containing 98.6 weight percent of the polychlorinated biphenyl contained in the waste lube oil and a heavy stream comprising essentially all of the non-distillable component of the waste lube oil including 99.5 weight percent of the heavy metals. The analysis of the overhead gas stream showed that the temperature-sensitive waste lube oil did not experience undesirable thermal cracking with the accompanying formation of normally gaseous hydrocarbonaceous compounds.

The process of the present invention is further demonstrated by the following illustrative embodiment. This illustrative embodiment is however not presented to unduly limit the process of this invention, but to further illustrate the advantages of the hereinabove described embodiments. The following data were not completely obtained by the actual performance of the present invention, but are considered prospective and reasonably illustrative of the expected performance of the invention.

ILLUSTRATIVE EMBODIMENT

A waste lube oil having the characteristics presented in Table 1 hereinabove and contaminated with 1020 ppm by weight of polychlorinated biphenyl (PCB) was charged at a rate of 100 mass units per hour to a hot hydrogen flash separation zone. The hot hydrogen was introduced into the hot hydrogen flash separation zone at a rate of 31 mass units per hour.

The waste lube oil was preheated to a temperature of <482° F. (<250° C.) before introduction into the hot hydrogen flash separation zone which temperature precluded any significant detectable thermal degradation. The waste lube oil was intimately contacted in the hot flash separation zone with a hot hydrogen-rich gaseous stream having a temperature upon introduction into the hot hydrogen flash separation zone of >748° F. (>398° ). In addition, the hot hydrogen flash separation zone was operated at conditions which included a temperature of 748° F. (398° C.), a pressure of 500 psig (3447 kPa gauge), a hydrogen circulation rate of 18000 SCFB (3034 normal $m^3/m^3$) and an average residence time of the vapor stream of 5 seconds. A hydrocarbonaceous vapor stream comprising hydrogen was recovered from the hot hydrogen flash separation zone, and directly introduced without separation into a hydrogenation reaction zone containing a hydrogenation catalyst comprising alumina, cobalt and molybdenum. The hydrogenation reaction is conducted with a catalyst peak temperature of 700° F. (371° C.), a pressure of 500 psig (3447 kPa gauge), a liquid hourly space velocity of 0.5 based on hydrocarbon feed to the hydrogenation reaction zone and a hydrogen circulation rate of 18,000 SCFB (3034 normal $m^3/m^3$). The hydrogenated effluent from the hydrogenation reaction zone including hydrogen chloride is contacted with an aqueous scrubbing solution containing sodium hydroxide, cooled to about 100° F. (38° C.), and sent to a vapor-liquid high pressure separator wherein a gaseous hydrogen-rich stream is separated from the normally liquid hydrocarbonaceous products and spent aqueous scrubbing solution containing sodium and chloride ions. The resulting gaseous hydrogen-rich stream is heated and then recycled to the hot hydrogen flash separation zone together with a fresh supply of hydrogen in an amount sufficient to maintain the hydrogenation reaction zone pressure. A hydrogenated hydrocarbonaceous stream comprising dissolved hydrogen is removed from the vapor-liquid high pressure separator and introduced into a product stabilizer which is maintained at a pressure of 10 psia (68.9 kPa absolute) and a temperature of 100° F. (38° C.). An overhead gaseous stream in an amount of <1 mass unit per hour and having the characteristics presented in Table 5 is recovered from the hereinabove mentioned product stabilizer.

TABLE 5

| ANALYSIS OF PRODUCT STABILIZER OVERHEAD GAS STREAM | |
|---|---|
| Component | Mole Percent |
| Hydrogen | 53.3 |
| $C_1$ | 15.4 |
| $C_2$ | 9.0 |
| $C_3$ | 7.9 |
| $C_4$ | 6.4 |
| $C_5$ | 3.8 |
| $C_6$+ | 4.2 |

A hydrogenated hydrocarbonaceous liquid stream in an amount of 87.1 mass units per hour having the characteristics presented in Table 6 is removed from the product stabilizer.

TABLE 6

| ANALYSIS OF HYDROGENATED HYDROCARONACEOUS LIQUID STREAM | | |
|---|---|---|
| Specific Gravity @60° F. (15° C.) | 0.855 | |
| Vacuum Distillation Boiling Range, (ASTM D-1160) | °F. | (°C.) |
| 10% | 430 | (221) |
| 50% | 725 | (384) |
| 90% | 890 | (476) |
| Sulfur, Weight percent | <0.1 | |
| Polychlorinated Biphenyl Concentration, wppm | <2 | |
| Lead, wppm | <0.03 | |
| Zinc, wppm | <0.01 | |
| Cadmium, wppm | <0.02 | |
| Copper, wppm | <0.01 | |
| Chromium, wppm | <0.6 | |

A non-distillable liquid stream is recovered from the bottom of the flash separation zone in an amount of 12 mass units per hour and having the characteristics presented in Table 7.

TABLE 7

| analysis OF NON-DISTILLABLE STREAM | |
|---|---|
| Specific Gravity @ 60° F. (15° C.) | >0.9 |
| Polychlorinated Biphenyl Concentration, wppm | 110 |

The foregoing description, drawing, example and illustrative embodiment clearly illustrate the advantages encompassed by the process of the present invention and the benefits to be afforded with the use thereof.

We claim:

1. A process for treating a temperature-sensitive hydrocarbonaceous stream containing a non-distillable component to produce a hydrogenated distillable hydrocarbonaceous product and a heavy product comprising said non-distillable component while minimizing thermal degradation of said hydrocarbonaceous stream which process comprises the steps of:

(a) contacting said hydrocarbonaceous stream with a first hydrogen-rich gaseous stream having a temperature greater than said hydrocarbonaceous stream in a flash zone at flash conditions thereby increasing the temperature of said hydrocarbonaceous stream with minimal thermal degradation and vaporizing at least a portion thereof to provide a hydrocarbonaceous vapor stream comprising hydrogen and a heavy product comprising said non-distillable component;

(b) contacting said hydrocarbonaceous vapor stream comprising hydrogen recovered from step (a) without intermediate separation with a hydrogenation catalyst in a hydrogenation reaction zone at hydrogenation conditions to increase the hydrogen content of the hydrocarbonaceous compounds contained in said hydrocarbonaceous vapor stream;

(c) condensing at least a portion of the resulting effluent from said hydrogenation reaction zone to provide a second hydrogen-rich gaseous stream and a liquid stream comprising hydrogenated distillable hydrocarbonaceous compounds; and (d) recovering a hydrogenated distillable hydrocarbonaceous product from said liquid stream comprising hydrogenated distillable hydrocarbonaceous compounds.

2. The process of claim 1 wherein said second hydrogen-rich gaseous stream recovered in step (c) is recycled to step (a).

3. The process of claim wherein said temperature-sensitive hydrocaronaceous stream comprises a component consisting essentially of dielectric fluids, hydraulic fluids, heat transfer fluids, used lubricating oil, used cutting oils, used solvents, still bottoms from solvent recycle operations, coal tars, atmospheric residuum, halogenated wastes and mixtures thereof.

4. The process of claim 1 wherein said non-distillable component comprises organometallic compounds, inorganic metallic compounds, finely divided particulate matter or non-distillable hydrocarbonaceous compounds.

5. The process of claim 1 wherein said temperature-sensitive hydrocarbonaceous stream is introduced into said flash zone at a temperature less than about 482° F. (250° C.).

6. The process of claim 1 wherein the temperature of said hot first hydrogen-rich stream is from about 200° F. (93° C.) to about 1200° F. (649° C.).

7. The process of claim 1 wherein said flash conditions include a temperature from about 150° F. (65° C.) to about 860° F. (460° C.), a pressure from about atmospheric to about 2000 psig (13788 kpa gauge), a hydrogen circulation rate of about 1000 SCFB (168 normal $m^3/m^3$) to about 30,000 SCFB (5056 normal $m^3/m^3$) based on said temperature-sensitive hydrocarbonaceous stream, and an average residence time of said hydrocarbonaceous vapor stream comprising hydrogen in said flash zone from about 0.1 seconds to about 50 seconds.

8. The process of claim 1 wherein said hydrogenation reaction zone is operated at conditions which include a pressure from about atmospheric (0 kPa gauge) to about 2000 psig (13790 kpa gauge), a maximum catalyst temperature from about 122° F. (50° C.) to about 850° F. (454° C.) and a hydrogen circulation rate from about 200 SCFB (33.7 normal $m^3/m^3$) to about 50,000 SCFB (8427 normal std $m^3/m^3$).

9. The process of claim 1 wherein said hydrogenation catalyst comprises a refractory inorganic oxide and at least one metallic compound having hydrogenation activity.

10. The process of claim 9 wherein said metallic compound is selected from the metals of Group VIB and VIII of the Periodic Table.

11. A process for treating a temperature-sensitive hydrocarbonaceous stream containing a non-distillable component to produce a hydrogenated distillable hydrocarbonaceous product and a heavy product comprising said non-distillable component while minimizing thermal degradation of said hydrocarbonaceous stream which process comprises the steps of:

(a) contacting said hydrocarbonaceous stream with a first hydrogen-rich gaseous stream having a temperature greater than said hydrocarbonaceous stream in a flash zone at flash conditions thereby increasing the temperature of said hydrocarbonaceous stream with minimal thermal degradation and vaporizing at least a portion thereof to provide a hydrocarbonaceous vapor stream comprising hydrogen and a heavy product comprising said non-distillable component;

(b) contacting said hydrocarbonaceous vapor stream comprising hydrogen recovered from step (a) without intermediate separation with a hydrogenation catalyst in a hydrogenation reaction zone at hydrogenation conditions to increase the hydrogen content of the hydrocarbonaceous compounds contained in said hydrocarbonaceous vapor stream;

(c) condensing at least a portion of the resulting effluent from said hydrogenation reaction zone to provide a second hydrogen-rich gaseous stream and a first liquid stream comprising hydrogenated distillable hydrocarbonaceous compounds; and (d) separating said first liquid stream comprising hydrogenated distillable hydrocarbonaceous compounds to provide a second hydrocarbonaceous vapor stream comprising normally gaseous hydrocarbons and a normally liquid hydrogenated distillable hydrocarbonaceous product.

12. The process of claim 11 wherein said second hydrogen-rich gaseous stream recovered in step (c) is recycled to step (a).

13. The process of claim 11 wherein said temperature-sensitive hydrocarbonaceous stream comprises a component consisting essentially of dielectric fluids, hydraulic fluids, heat transfer fluids, used lubricating oil, used cutting oils, used solvents, still bottoms from solvent recycle operations, coal tars, atmospheric residuum, halogenated wastes and mixtures thereof.

14. The process of claim 11 wherein said non-distillable component comprises organometallic compounds, inorganic metallic compounds, finely divided particulate matter or non-distillable hydrocarbonaceous compounds.

15. The process of claim 11 wherein said temperature-sensitive hydrocarbonaceous stream is introduced into said flash zone at a temperature less than about 482° F. (250° C.)

16. The process of claim 11 wherein the temperature of said hot first hydrogen-rich stream is from about 200° F. (93° C.) to about 1200° F. (649° C.)

17. The process of claim 11 wherein said flash conditions include a temperature from about 150° F. (65° C.) to about 860° F. (460° C.), a pressure from about atmospheric to about 2000 psig (13788 kpa gauge), a hydrogen circulation rate of about 1000 SCFB (168 normal $m^3/m^3$) to about 30,000 SCFB (5056 normal $m^3/m^3$) based on said temperature-sensitive hydrocarbonaceous stream, and an average residence time of said hydrocarbonaceous vapor stream comprising hydrogen in said flash zone from about 0.1 seconds to about 50 seconds.

18. The process of claim 11 wherein said hydrogenation reaction zone is operated at conditions which include a pressure from about atmospheric (0 kPa gauge) to about 2000 psig (13790 kpa gauge), a maximum catalyst temperature from about 122° F. (50° C.) to about 850° F. (454° C.) and a hydrogen circulation rate from about 200 SCFB (33.7 normal $m^3/m^3$) to about 50,000 SCFB (8427 normal std $m^3/m^3$).

19. The process of claim 11 wherein said hydrogenation catalyst comprises a refractory inorganic oxide and at least one metallic compound having hydrogenation activity.

20. The process of claim 19 wherein said metallic compound is selected from the metals of Group VIB and VIII of the Periodic Table.

21. A process for treating a temperature-sensitive hydrocarbonaceous stream containing a non-distillable component to produce a hydrogenated distillable hydrocarbonaceous product and a heavy product comprising said non-distillable component while minimizing thermal degradation of said hydrocarbonaceous stream which process comprises the steps of:

(a) contacting said hydrocarbonaceous stream with a first hydrogen-rich gaseous stream having a temperature greater than said hydrocarbonaceous stream in a flash zone at flash conditions thereby increasing the temperature of said hydrocarbonaceous stream with minimal degradation and vaporizing at least a portion thereof to provide a hydrocarbonaceous vapor stream comprising hydrogen and a heavy product comprising said non-distillable component;

(b) contacting said hydrocarbonaceous vapor stream comprising hydrogen recovered from step (a) without intermediate separation with a hydrogenation catalyst in a hydrogenation reaction zone at hydrogenation conditions to simultaneously increase the hydrogen content of the hydrocarbonaceous compounds contained in said hydrocarbonaceous vapor stream and to generate at least one water-soluble inorganic compound produced from the reaction of said hydrocarbonaceous compounds and said hydrogen;

(c) contacting the resulting effluent from said hydrogenation zone containing hydrogenated hydrocarbonaceous compounds and at least one water-soluble inorganic compound with a fresh aqueous scrubbing solution;

(d) introducing a resulting admixture of said effluent from said hydrogenation zone and said aqueous scrubbing solution into a separation zone to provide a second hydrogen-rich gaseous stream, a first liquid stream comprising hydrogenated distillable hydrocarbonaceous compounds and a spent aqueous scrubbing solution containing at least a portion of said water-soluble inorganic compound; and (e) separating said first liquid stream comprising hydrogenated distillable hydrocarbonaceous compounds to provide a second hydrocarbonaceous vapor stream comprising normally gaseous hydrocarbons and a normally liquid hydrogenated distillable hydrocarbonaceous product.

22. The process of claim 21 wherein said second hydrogen-rich gaseous stream recovered in step (c) is recycled to step (a).

23. The process of claim 21 wherein said temperature-sensitive hydrocarbonaceous stream comprises a component consisting essentially of dielectric fluids, hydraulic fluids, heat transfer fluids, used lubricating oil, used cutting oils, used solvents, still bottoms from solvent recycle operations, coal tars, atmospheric residuum, halogenated wastes and mixtures thereof.

24. The process of claim 21 wherein said non-distillable component comprises organometallic compounds, inorganic metallic compounds, finely divided particulate matter or non-distillable hydrocarbonaceous compounds.

25. The process of claim 21 wherein said temperature-sensitive hydrocarbonaceous stream is introduced into said flash zone at a temperature less than about 482° F. (250° C.)

26. The process of claim 21 wherein the temperature of said hot first hydrogen-rich stream is from about 200° F. (93° C.) to about 1200° F. (649° C.).

27. The process of claim 21 wherein said flash conditions include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on said temperature-sensitive hydrocarbonaceous stream, and an average residence time of said hydrocarbonaceous vapor stream comprising hydrogen in said flash zone from about 0.1 seconds to about 50 seconds.

28. The process of claim 21 wherein said hydrogenation reaction zone is operated at conditions which include a pressure from about atmospheric (0 kPa gauge) to about 2000 psig (13790 kpa gauge), a maximum catalyst temperature from about 122° F. (50° C.) to about 850° F. (454° C.) and a hydrogen circulation rate from about 200 SCFB (33.7 normal $m^3/m^3$) to about 50,000 SCFB (8427 normal std $m^3/m^3$).

29. The process of claim 21 wherein said hydrogenation catalyst comprises a refractory inorganic oxide and at least one metallic compound having hydrogenation activity.

30. The process of claim 29 wherein said metallic compound is selected from the metals of Group VIB or VIII of the Periodic Table.

31. The process of claim 21 wherein said water-soluble inorganic compound is selected from the group consisting of hydrogen sulfide, ammonia, hydrogen chloride, hydrogen bromide and hydrogen fluoride.

32. The process of claim 21 wherein said aqueous scrubbing solution comprises a compound selected from the group consisting of calcium hydroxide, potassium hydroxide and sodium hydroxide.

* * * * *